United States Patent [19]

Yoshikawa

[11] Patent Number: 4,505,008

[45] Date of Patent: Mar. 19, 1985

[54] ADJUSTABLE FASTENER

[75] Inventor: Kiichi Yoshikawa, Osaka, Japan

[73] Assignee: Yoshida Kogyo K.K., Tokyo, Japan

[21] Appl. No.: 603,140

[22] Filed: Apr. 23, 1984

Related U.S. Application Data

[63] Continuation of Ser. No. 322,284, Nov. 17, 1981.

[30] Foreign Application Priority Data

| | | | |
|---|---|---|---|
| Dec. 2, 1980 | [JP] | Japan | 55-172992 |
| Dec. 2, 1980 | [JP] | Japan | 55-172993 |
| Dec. 2, 1980 | [JP] | Japan | 55-172994 |
| Dec. 2, 1980 | [JP] | Japan | 55-172995 |
| Mar. 23, 1981 | [JP] | Japan | 56-40469 |

[51] Int. Cl.[3] ..... A44B 19/40

[52] U.S. Cl. ..... 24/401; 24/389; 24/408; 24/585

[58] Field of Search ..... 24/401, 389, 408, 382, 24/386, 585, 68 R, 70 R; 264/249

[56] References Cited

U.S. PATENT DOCUMENTS

| | | | |
|---|---|---|---|
| 2,441,377 | 5/1948 | Taberlet | 24/68 R |
| 2,463,840 | 3/1949 | Winterhalter | 264/249 |
| 2,636,239 | 4/1953 | Vizner | 24/585 |
| 2,770,024 | 11/1956 | Statham | 24/68 R |
| 3,711,903 | 1/1973 | Brown | 24/401 |
| 4,133,082 | 1/1979 | Kanzaka | 24/68 R |
| 4,290,175 | 9/1981 | Moertel | 24/408 |
| 4,338,706 | 7/1982 | Aoki | 24/70 R |

*Primary Examiner*—Victor N. Sakran

*Attorney, Agent, or Firm*—Hill, Van Santen, Steadman & Simpson

[57] ABSTRACT

An adjustable fastener which comprises a rail having a plurality of spaced-apart stop elements affixed thereto along the length thereof, and a slider fit on the rail for adjustable sliding movement therealong. The rail is manufactured by affixing the stop elements to at least one flexible connecting member at a predetermined pitch therealong by means of extrusion or injection molding. Various embodiments of the rail are disclosed.

10 Claims, 53 Drawing Figures

ADJUSTABLE FASTENER

This is a continuation of application Ser. No. 322,284, filed Nov. 17, 1981.

BACKGROUND OF THE INVENTION

1. Field of the Invention

This invention relates to an adjustable fastener of the type that does not possess a supporting tape, and which is attached to an adjustable portion of a pair of trousers, a skirt or jacket or the like to enable adjustment of girth, and to the adjustable portion of a hat or cap to allow for adjustment of head size. The adjustable fastener of the type described comprises an elongate rail having a series of spaced-apart stop elements affixed thereto longitudinally thereof, and a slider which is fit on the rail and movable therealong for locking engagement therewith at a selected position on the rail.

2. Description of the Prior Art

In the conventional rails each of the stop elements is affixed to a cord or band at a given pitch by means of a clamping operation, as set forth in, for example, U.S. Pat. No. 2,441,337 and U.S. Pat. No. 2,770,024. Attaching the stop elements by clamping is an extremely troublesome and time-consuming operation that does not permit efficient manufacture of the rails. Moreover, consistent rail quality cannot be achieved owing to slight variations in clamping conditions and in stop element pitch. Another disadvantage is that attaching the stop elements by clamping diminishes the flexibility of the cord or band and results in a stiffened article. When a fastener having such stiffness is attached to the adjustable portion of a pair of trousers or the like, the adjustable portion itself loses flexibility and develops wrinkles, presenting an unattractive appearance. This tendency is particularly pronounced when the fastener is applied to a thin fabric. In fact, whether the fastener can be used or not is determined by the fabric itself because of the above problem. There are even cases where the commercial value of a garment is diminished by the application of the conventional fastener.

SUMMARY OF THE INVENTION

The present invention seeks to solve the foregoing problems encountered in the prior art.

Accordingly, the first object of the present invention is to provide an adjustable fastener having a rail structure composed of spaced-apart stop elements affixed by extrusion or injection molding to at least one flexible connecting member such as a woven or knitted band or cord or a highly flexible synthetic resin band or cord, whereby the fastener can be stitched into place on a garment and fit perfectly to the garment surface by exploiting the flexibility of the connecting member, whereby the stop elements can be affixed to the connecting member efficiently while the strength with which they are attached is maintained as well as the accurate spacing between them, and whereby the fastener can be mass produced with high efficiency while maintaining a consistent high quality.

A second object of the present invention is to provide an adjustable fastener having a rail structure composed of spaced-apart stop elements interconnected at the central portion thereof, when measured across their width, by means of a single flexible, strip-like connecting member, with the connecting member portion of the fastener serving as the part by which the fastener is attached to a garment by stitching, whereby the stop elements can be stabilized and the fastener stitched firmly into place on a garment and fit perfectly to the garment surface by the stitches applied to the flexible connecting member portion extending longitudinally of the rail at centrally located points laterally of the rail, and whereby the stop elements, and hence the rail, can be stabilized as long as the connecting member portion and stop elements are interconnected, regardless of how this interconnection is accomplished.

A third object of the present invention is to provide an adjustable fastener having a rail structure composed of spaced-apart stop elements fixedly secured to a flexible ladder-shaped connecting member comprising side elements and rung elements, with the stop elements having the side elements and rung elements embedded therein and being interconnected with the other portions of the side elements, whereby the fastener can be attached to a garment and fit perfectly to the garment surface by exploiting the flexibility of the ladder-shaped connecting member, and whereby the stop elements can be secured to the connecting member very firmly at a predetermined pitch owing to the portions of the stop elements where the side and rung elements are embedded.

A fourth object of the present invention is to provide an adjustable fastener having a rail structure composed of spaced-apart stop elements affixed by extrusion or injection molding to and astride three flexible connecting members extending in parallel, with those portions of the connecting member interconnecting the stop elements at centrally located points laterally of the rail serving as the parts at which the fastener is attached to a garment by stitching, whereby the stop elements can be affixed to the connecting members efficiently while the strength with which they are attached is maintained as well as the accurate spacing between them, whereby the fastener can be mass produced with high efficiency while maintaining a consistent high quality, whereby the stop elements can be stabilized by the stitches applied at the connecting member portion situated centrally laterally of the rail, whereby such stability is enhanced by the side element portions situated on the right and left sides laterally of the rail, and whereby the fastener can be firmly attached to a garment and fit perfectly to the garment surface by exploiting the flexibility of the connecting members.

A fifth object of the present invention is to provide an adjustable fastener having a rail structure composed of spaced-apart stop elements affixed by extrusion or injection molding to and astride two flexible connecting members extending in parallel, and a connecting strip made of synthetic resin for interconnecting the stop elements together into a unitary body at centrally located portions laterally of the stop elements, whereby the abovementioned advantages of an adjustable fastener are assured as well as a fastener whose slider can be slid therealong very smoothly.

Other objects, effects and characterizing features of the present invention will be apparent from the following description of preferred embodiments thereof taken in conjunction with the accompanying drawings.

DETAILED DESCRIPTION OF THE PREFERRED EMBODIMENT

Figure 1:
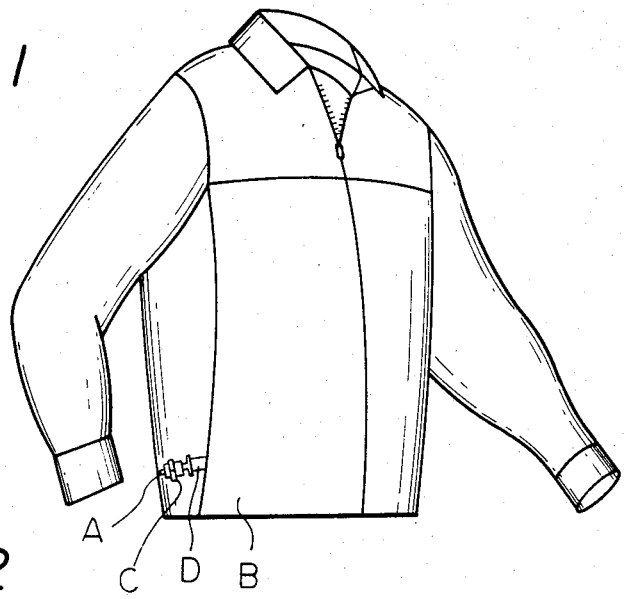
FIG. 1 is a perspective view showing the novel adjustable fastener of the invention attached to a jacket.
Figure 2:
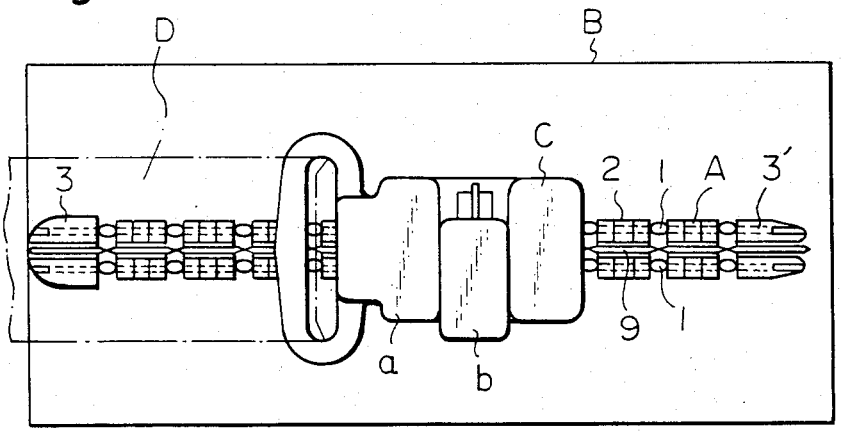
FIGS. 2 and 3 are plan and side views, respectively, showing the use of the adjustable fastener of the present invention in a first embodiment thereof.
Figure 3:
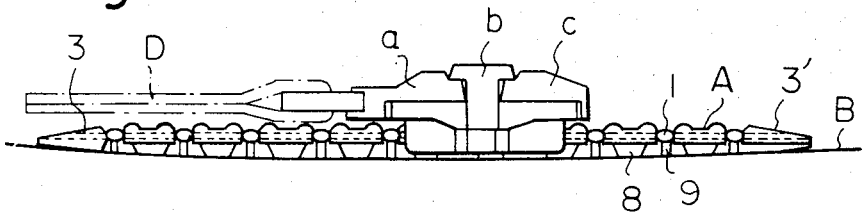
Figure 4:
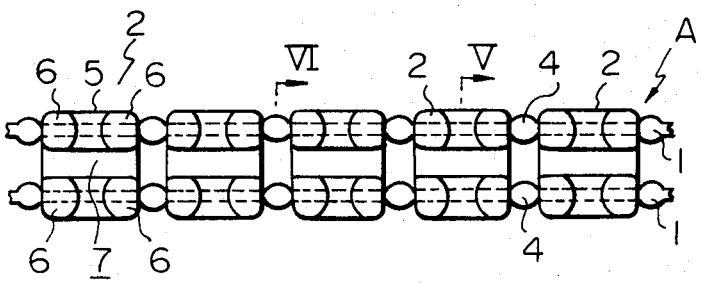
FIG. 4 is a plan view showing a rail portion of the first embodiment of the present invention.
Figure 5:
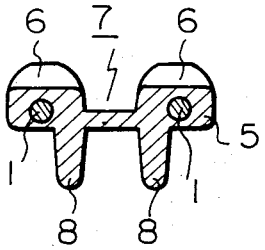
FIGS. 5 and 6 are sectional views taken along the lines V and VI of FIG. 4, respectively.
Figure 6:
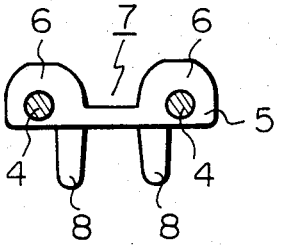

Reference will first be had to FIGS. 1 through 9 to describe the first embodiment of the present invention. In FIGS. 1 through 3, A represents a rail, B a garment, C a slider, and D an attachment band. The rail A includes a pair of elongate flexible connecting members 1, 1 extending in parallel, as well as a plurality of spaced-apart stop elements 2, a slider stopper 3 and a slider insertion guide 3' affixed to and astride the connecting members 1, 1 by extrusion or injection molding. Each connecting member 1 is a cord having spaced-apart expanded portions 4 provided along its length. Each stop element 2 has a square base portion 5 the left and right side edges of which are penetrated by the embedded connecting members 1. The stop element 2 further includes two slider engaging projections 6, 6, spaced apart fore and aft by a predetermined distance, provided at the edges of both the left and right sides of the base portion 5 on the obverse surface thereof, a stitching groove 7 formed longitudinally along the central portion of the base portion 5, and a slider guiding projection 8 provided on the right and left sides of the base portion 5 on the reverse side thereof. Moreover, the stop elements 2 are pressed at their fore and aft sides by and between the expanded portions 4, 4 of the connecting members and therefore are held firm against shifting movement longitudinally of the rail, with the above-mentioned predetermined distance between the slider engaging projections 6, 6 being maintained also between projections 6, 6 on the mutually adjacent stop elements 2, 2.

The rail A having the foregoing construction is disposed with the slider guiding projections 8 abutting against the surface of the adjustable portion of the garment B, and is stitched into place on the garment with a thread 9 passed through the stitching groove 7.

The slider C, made of a synthetic resin, includes a body member a having a rail guiding channel, and a movable member b provided on the body member a and slidable at right angles to the rail guiding channel. The movable member b is provided with locking projections (not shown) engageable with the slider engaging projections 6, 6 on the left and right sides of the rail A by sliding the movable member b. The slider C is attached to the attachment band D provided on the garment B, and has its rail guiding channel fit over the rail A so that the slider C is slidable therealong.

The stop elements 2 in the above arrangement are fixedly secured to the connecting members 1, 1 at a predetermined pitch in a unitary manner owing to the adhesive force resulting from the extrusion or injection molding operation, and a satisfactory degree of flexibility is maintained at the portions of the connecting members 1 between the stop elements 2, 2. This assures an attractive appearance since the rail A can be fit exactly to the surface of the garment B and stitched into place without the occurrence of stiffness or wrinkles. Moreover, the slider C can be slid smoothly along the rail A which exhibits enhanced stability because each stop element 2 is supported in abutting contact with the surface of the garment B at the left and right slider guiding projections 8 which are elongated along the length of the rail. The modification shown in FIGS. 8 and 9 may be adopted to enhance the stability of the rail A even further, wherein the expanded portions 4 are eliminated from the connecting members 1 and the spacing between adjacent stop elements 2, 2 is narrowed as much as possible but not to such an extent as will diminish rail flexibility.

Figure 10:
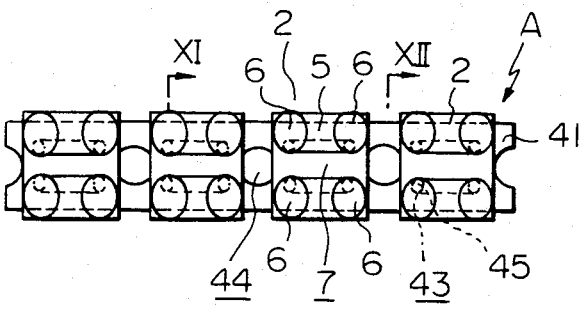
FIG. 10 is a plan view illustrating a rail portion of a second embodiment of the present invention.
Figure 11:
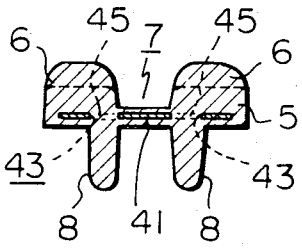
FIGS. 11 and 12 are sectional views taken along the lines XI and XII of FIG. 10, respectively.
Figure 12:
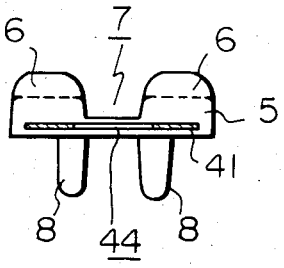

A second embodiment of the invention is illustrated in FIGS. 10 through 12. The rail A according to this embodiment includes a connecting member 41 comprising a woven or knitted band or a band made of synthetic resin, and spaced-apart stop elements 2 affixed to the connecting member 41 along its length by injection or extrusion molding, each slider engaging projection 6 and slider guiding projection 8 of the stop elements being interconnected via a through-hole 43 bored in the connecting member 41. The connecting member 41 has a stitching window 44 bored through each portion thereof located between and interconnecting adjacent stop elements 2, 2. The rail A is stitched into place on the surface of the garment using the stitching grooves 7 in the stop elements 2 and the stitching windows 44 in the connecting member 41.

The rail A of this embodiment is distinguishable over that of the first embodiment in that a column 45 is formed joining the slider engaging projection 6 and slider guiding projection 8 of the stop elements 2 through the through-hole 43 of the connecting member 41. With the arrangement of this embodiment the effect of preventing shifting of the stop elements 2 is enhanced by the column 45 passing through the connecting member 41.

Figure 13:
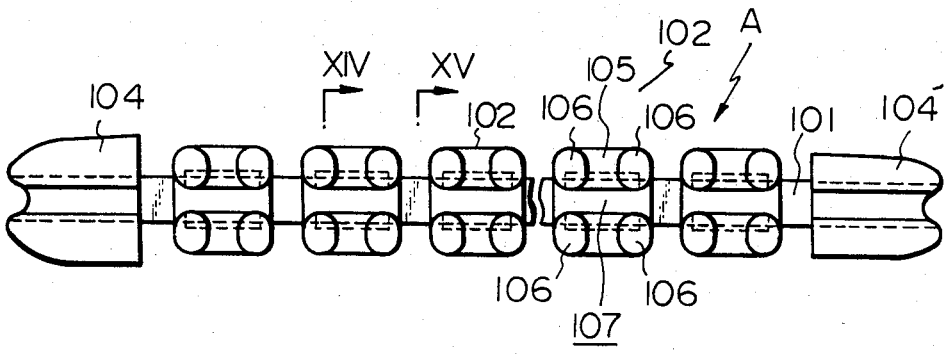
FIG. 13 is a plan view of a rail portion of a third embodiment of the present invention.
Figure 14:
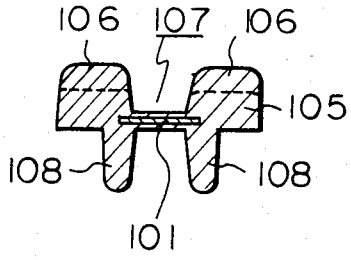
FIGS. 14 and 15 are sectional views taken along the lines XIV and XV of FIG. 13.
Figure 15:
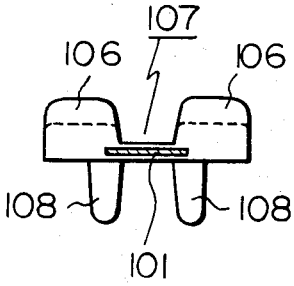

According to the third embodiment of the invention as illustrated in FIGS. 13 through 15, the rail A includes a single strip-like connecting member 101 comprising a woven or knitted band, and spaced-apart stop elements 102 affixed to the connecting member 101 by extrusion or injection molding. The stop elements 102, 102 are interconnected by the connecting member 101, extending longitudinally of the rail, at the central portions of the stop elements laterally thereof, i.e., when measured across the width thereof. A slider stopper 104 and a slider insertion guide 104' are affixed to the respective ends of the connecting member 101 by injection or extrusion molding.

Each stop element 102 has a square base portion 105, two slider engaging portions 106, 106, spaced apart by a predetermined distance longitudinally of the rail, provided at the edges of both the left and right sides of the base portion 105 on the obverse surface thereof, a stitching groove 107 formed in the obverse surface of the stop element 102 at the central portion thereof when measuring the stop element across its width, and slider guiding projections 108, 108 provided on the right and left sides of the base portion 105 on the reverse surface thereof. The stop elements 102 are fixedly secured to the connecting member 101 in a unitary manner owing to the adhesive force resulting from the extrusion or injection molding operation, with the connecting member 101 passing through the base portion 105 at its central part when measuring the base portion across its width. The abovementioned predetermined distance between the slider engaging projections 106, 106 is maintained also between the projections 106, 106 on mutually adjacent stop elements 102.

In accordance with the above embodiment, the rail A is stitched into place at those portions of the longitudinally extending strip-like connecting member 101 that have flexibility, namely at the central portion of the rail when measuring the rail across its width. It is therefore possible to stabilize the stop elements 102 and to attach the rail to the garment B firmly with the rail fit exactly to the garment surface. Furthermore, since the stop elements 102 are fixedly secured to the strip-like connecting member 101 by means of the strong adhesive force provided by the extrusion or injection molding step, the rail A can be manufactured very efficiently without sacrificing the flexibility of the connecting member at the locations between the stop elements. The end result is greatly improved productivity.

Figure 7:
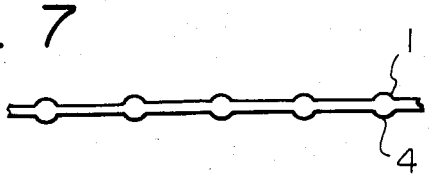
FIG. 7 is a side view of a cord.
Figure 8:
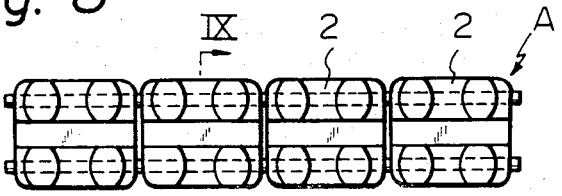
FIG. 8 is a plan view illustrating a modification of the first embodiment.
Figure 9:
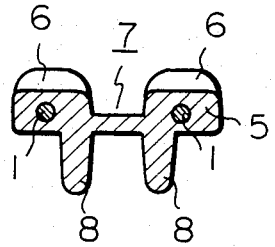
FIG. 9 is a sectional view taken along the line IX of FIG. 8.
Figure 17:
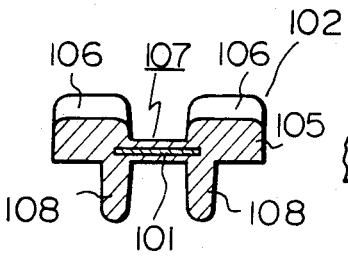
FIG. 17 is a sectional view taken along the line XVII of FIG. 16.
Figure 16:
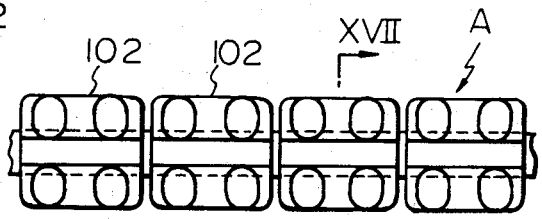
FIG. 16 is a plan view illustrating a rail portion which is a modification of the third embodiment.

In the embodiment of FIGS. 13 through 15, the stop elements 102, 102 are interconnected by the strip-like connecting member 101 at their central portions when the stop elements are measured across their width. The modification shown in FIGS. 16 and 17 may be adopted to further improve the stability of the rail A. Specifically, as shown in FIGS. 16 and 7, the spacing between adjacent stop elements 102, 102 can be narrowed as much as possible but not to such an extent as will diminish the flexibility of the rail A.

Figure 18:
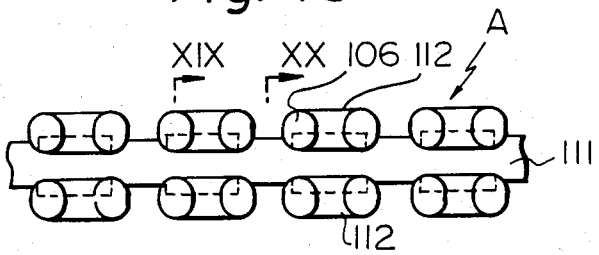
FIG. 18 is a plan view showing a rail portion of a fourth embodiment of the present invention.
Figure 19:
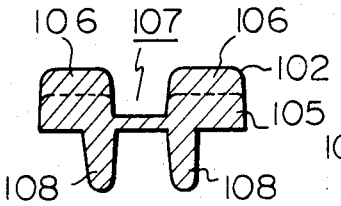
FIGS. 19 and 20 are sectional views taken along the lines XIX and XX of FIG. 18, respectively.
Figure 20:
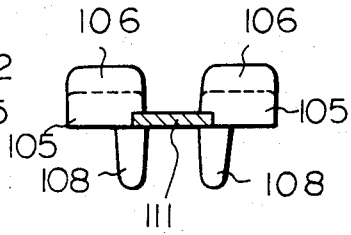

A fourth embodiment of the invention is illustrated in FIGS. 18 through 20, in which the rail A of the adjustable fastener includes a strip-like connecting member 111 comprising a flexible band made of a synthetic resin, and longitudinally spaced-apart complementary stop elements 112, 112 formed integrally with the connecting member 111 on the left and right sides thereof so as to oppose each other across the connecting member 111, the stop elements and connecting member being formed by extrusion or injection molding.

Figure 21:
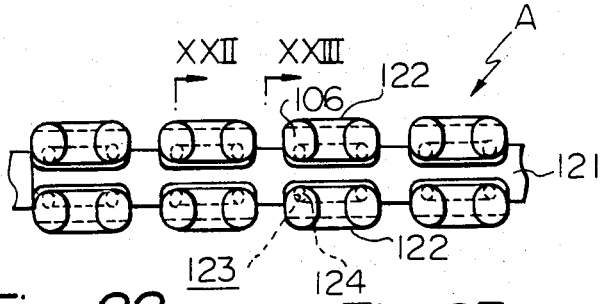
FIG. 21 is a plan view showing a rail portion of a fifth embodiment of the present invention.
Figure 22:
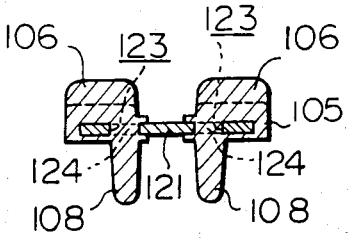
FIGS. 22 and 23 are sectional views taken along the lines XXII and XXIII of FIG. 21, respectively.
Figure 23:
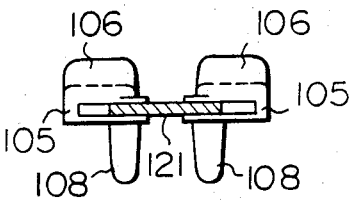

A fifth embodiment of the invention is illustrated in FIGS. 21 through 23. The rail A according to this embodiment includes a strip-like connecting member 121 comprising a woven or knitted band, and complementary stop elements 122, 122 spaced apart longitudinally of the rail and affixed to the left and right sides of the connecting member 121, in the same arrangement as the stop elements 112 of the fourth embodiment, by extrusion or injection molding. Each slider engaging projection 106 and slider guiding projection 108 of a complementary stop element 122 is interconnected by a column 124 formed in a through-hole 123 bored through the connecting member 121. Thee characterizing feature of this embodiment resides in the firm attachment of the stop elements to the connecting member, this being achieved by dividing each stop element into discrete complementary elements affixed to the connecting member so as to oppose each other.

Figure 24:
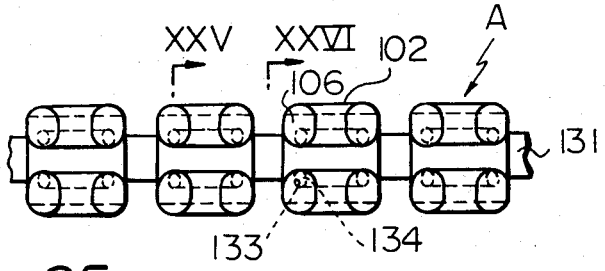
FIG. 24 is a plan view showing a rail portion of a sixth embodiment of the present invention.
Figure 25:
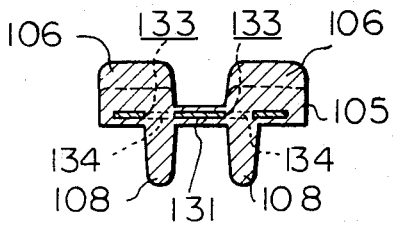
FIGS. 25 and 26 are sectional views taken along the lines XXV and XXVI of FIG. 24, respectively.
Figure 26:
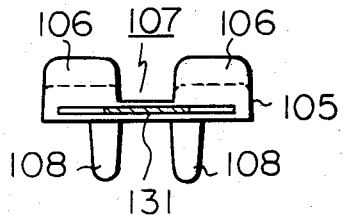
Figure 27:
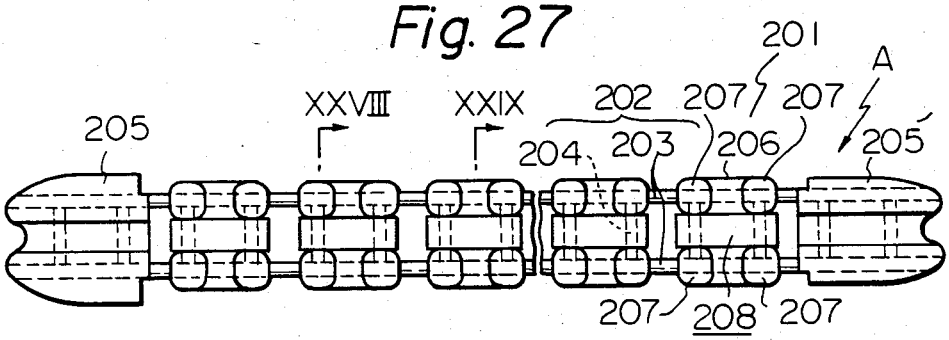
FIG. 27 is a plan view showing a rail portion of a seventh embodiment of the present invention.
Figure 28:
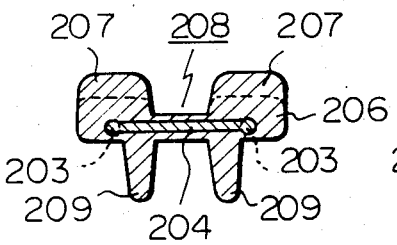
FIGS. 28 and 29 are sectional views taken along the lines XXVIII and XXIX of FIG. 27, respectively.
Figure 29:
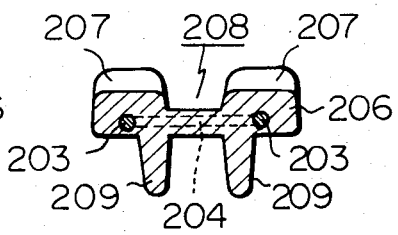
Figure 30:
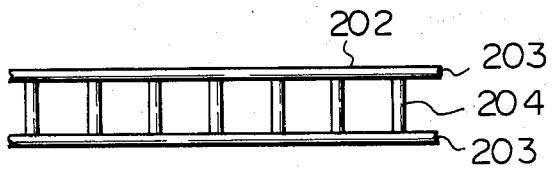
FIG. 30 is a plan view showing a connecting member of the seventh embodiment.

A sixth embodiment of the invention will now be described with reference to FIGS. 24 through 26. The rail A of the adjustable fastener includes a broad strip-like connecting member 131 comprising a woven or knitted band, and spaced-apart stop elements 102 affixed to the connecting member 131 by extrusion or injection molding. Each slider engaging projection 106 and slider guiding projection 108 of a stop element 102 is interconnected by a column 134 formed in a through-hole 133 bored through the connecting member 131. The sections of the connecting member 131 exposed between adjacent stop elements 102 have both side edges thereof partially cut away, as may be understood by comparing the sectional views of FIGS. 25 and 26. The arrangement of this embodiment is even more effective than that of the third embodiment in preventing shifting of the stop elements by virtue of the column 134, and at the same time provides excellent rail stability which is superior to that of the fifth embodiment since the stop elements are not divided into the left and right complementary portions.

In accordance with the third through sixth embodiments of the invention as described above, the stop elements of the rail A are interconnected at the central portion thereof, when measuring the stop elements across their width, by means of a single strip-like connecting member which exhibits flexibility, the portion of the rail constituted by the connecting member serving as the part at which the rail is fixedly attached to the garment by stitching. Attaching the rail to the garment by stitching at said portion contributes to the stability of the stop elements. Moreover, arranging it so that there is no loss of flexibility at said portion permits the rail to be fit exactly to the garment surface and to be attached to the garment firmly in a stable manner.

A seventh embodiment of the invention is illustrated in FIGS. 27 through 33. Here the rail A includes a connecting member 202 knitted in the form of a ladder having side elements 203 and rung elements 204 bridging the side elements, and spaced-apart stop elements 201 affixed to the connecting member 202 by extrusion or injection molding, with the side elements 203 and rung elements 204 being embedded within the stop elements 201. Thus the stop elements are interconnected by the exposed portions of the side elements 203. A slider stopper 205 and a slider insertion guide 205' are affixed to the respective end portions of the connecting member 202 by extrusion or injection molding.

Each stop element 201 has a square base portion 206, two slide engaging portions 207, 207, spaced apart by a predetermined distance longitudinally of the rail, provided at the edges of both the left and right sides of the base portion 206 on the obverse side thereof, a stitching groove 208 formed in the obverse side of the stop element 201 at the central portion thereof when measuring the stop element across its width, and slider guiding projections 209, 209 provided on the right and left sides of the base portion 206 on the reverse surface thereof. The stop elements 201 are fixedly secured to the connecting member 202 in a unitary manner owing to the adhesive force resulting from the extrusion or injection molding operation, with the connecting member 202 passing through the base portion 206. The abovementioned predetermined distance between the slider engaging projections 207, 207 is maintained also between the projections 207, 207 on mutually adjacent stop elements 201.

The connecting member 202 may be punched or cut out of a woven or knitted band of thermoplastic synthetic resin fibers or out of a film made of synthetic resin, or it may be knitted into the ladder shape. If the connecting member is to be obtained from the band of woven or knitted fibers, the preferred method is a seal-cut method using an ultrasonic cutting technique in order to prevent fraying of the fibers.

Figure 31:
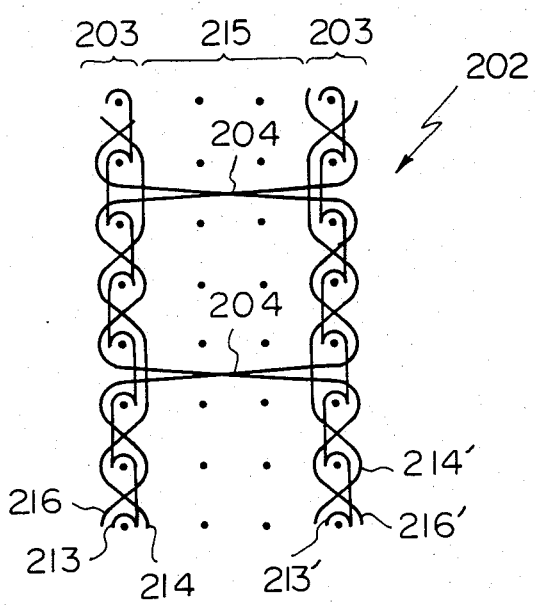
FIG. 31 is a point diagram showing the knit structure of the connecting member.

FIG. 31 is a point diagram for the structure of the connecting member when it is formed by knitting. The left side element 203 of the connecting member comprises a knit structure formed by a chain stitch 213 of a 1-0/0-1 pattern and a warp-knitted yarn 214 laid in the 0-0/1-1/0-0 pattern. Likewise, the right side element 203 comprises a knit structure formed by a chain stitch 213' of a 1-0/0-1 pattern and a warp-knitted yarn 214' laid in the 1-1/0-0/1-1 pattern. The region 215 between the side elements that is devoid of wales has yarns 216, 216' laid in the patterns 0-0/1-1/0-0/4-4/3-3/4-4 and 4-4/3-3/4-4/0-0/1-1/0-0. Thus, each rung element 204 is composed of the yarn portions 216, 216' located in the region 215.

In the above arrangement, the stop elements 201 are fixedly secured to the connecting member 202 at a predetermined pitch firmly and in a unitary manner owing to the adhesive force resulting from the extrusion of injection molding operation, with flexibility being maintained at the side elements of the connecting member 202 between adjacent stop elements 201, and with the stop element chain being held together firmly by the connecting member 202. This assures an attractive appearance since the rail A can be fitted exactly to the surface of the garment B and stitched in place without stiffening or wrinkling. Moreover, the stop elements 201 will not become dislodged from the connecting member 202 and, since the rung elements 204 are embedded in the stop elements, the latter will not be displaced longitudinally of the rail even when they are pulled strongly by the locking projections of the slider C. The rail A therefore has stop elements strong enough to withstand use on garment portions that are subjected to intense pulling force, such as at the waste of a skirt or pair of trousers. In addition, the efficiency of the manufacturing operation is improved greatly since the stop elements are formed by extrusion or injection molding.

Figure 32:
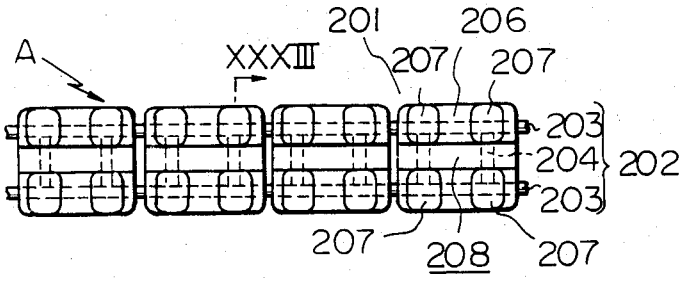
FIG. 32 is a plan view showing a rail portion which is a modification of the seventh embodiment.
Figure 33:
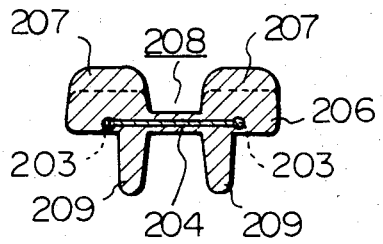
FIG. 33 is a sectional view taken along the line XXXIII of FIG. 32.

By stitching the stop elements 201 into place using the stitching groove 208 located at the central portion thereof when measured across the width of the stop element, the slider guiding projections 209, 209 on each stop element 201 are abutted against the garment surface to stabilize the stop element chain, this stability being enhanced further by the right and left side elements of the connecting member 202 at the portions between adjacent stop elements. The end result is a rail A of excellent stability along which the slider C can be slid very smoothly. The modification shown in FIGS. 32 and 33 is effective in enhancing the stability of the rail A even further. Here the enhanced stability is achieved by narrowing the spacing between the adjacent stop elements 201, 201 as much as possible but not to such an extent as will diminish the flexibility of the rail A.

Figure 34:
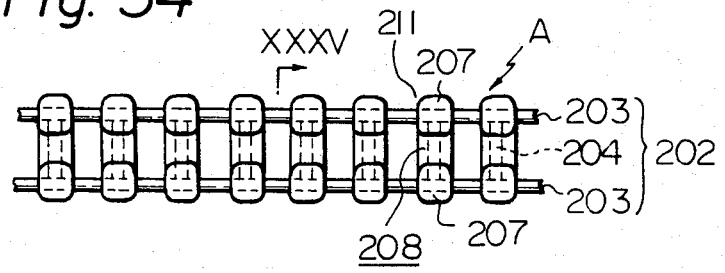
FIG. 34 is a plan view showing a rail portion of an eighth embodiment of the present invention.
Figure 35:
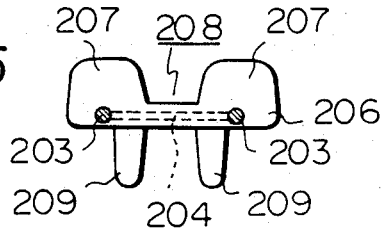
FIG. 35 is a sectional view taken along the line XXXV of FIG. 37.

FIGS. 34 and 35 illustrate an eighth embodiment of the present invention. As shown, the rail A includes the connecting member 202 having the rung members 204, and stop elements 211 each provided at one of the rung elements 204. The rail of this arrangement is equivalent to an arrangement that would result by dividing the stop elements 201 of the seventh embodiment into two halves longitudinally of the rail. The rail A of this embodiment therefore has greater flexibility than that of the seventh embodiment, particularly in the longitudinal direction.

Figure 36:
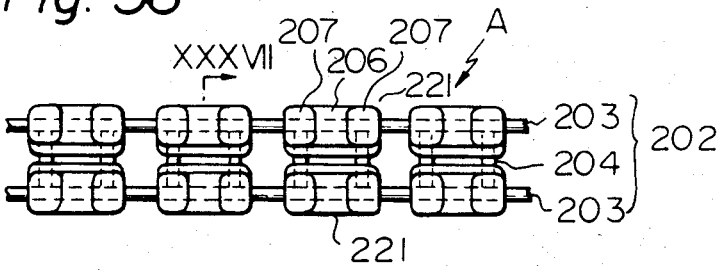
FIG. 36 is a plan view showing a rail of a ninth embodiment of the present invention.
Figure 37:
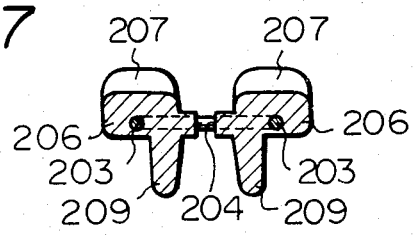
FIG. 37 is a sectional view taken along the line XXXVII of FIG. 36.
Figure 38:
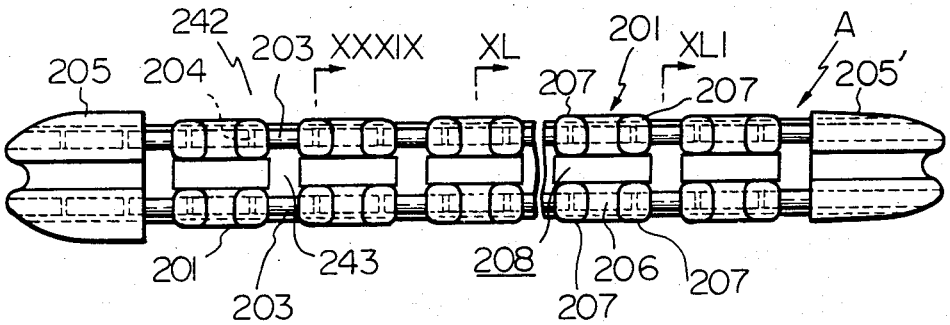
FIG. 38 is a plan view showing a rail of a tenth embodiment of the present invention.
Figure 39:
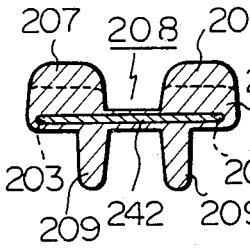
FIGS. 39 through 41 are sectional views taken along the lines XXXIX, XL and XLI of FIG. 38, respectively.
Figure 40:
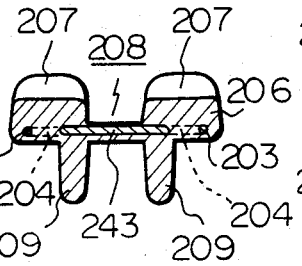
Figure 41:
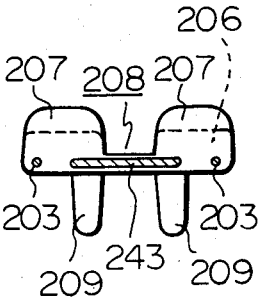
Figure 42:
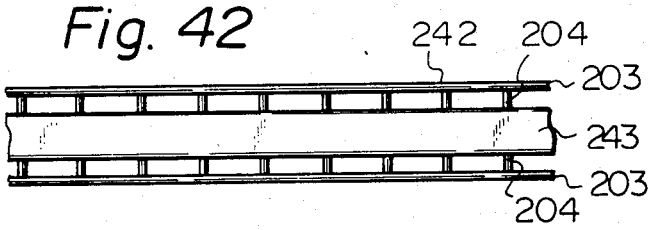
FIG. 42 is a plan view showing a connecting member of the tenth embodiment.

FIGS. 36 and 37 depict a ninth embodiment of the invention, in which the rail A includes stop elements 221 equivalent to those that would result by dividing the stop elements 201 of the seventh embodiment into halves in the direction of the width of the rail. The rail A of this embodiment therefore has greater flexibility than that of the seventh embodiment, particularly in the direction of rail width.

A 10th embodiment of the invention will now be described with reference to FIGS. 38 through 43. The rail A of this embodiment includes a ladder-shaped connecting member 242 having the left and right side elements 203, 203, a strip-like intermediate element 243 disposed intermediate the side elements 203, 203, and the rung elements 204 extending between the intermediate element 243 and the elements 203, 203 on either side thereof, as well as the stop elements 201; those portions of the intermediate element 243 between the adjacent stop elements 201 serving as the parts at which the rail is fixed are secured to the garment by stitching. More specifically, a yarn is passed over said portions, engaged with the stitching groove 208, and then stitched into the surface of the garment. Accordingly, since the rail A is stitched into the garment at the longitudinally extending intermediate element 243 centrally of the rail, the slider guiding projections 209, 209 on each stop element 201 are abutted against the garment surface to furnish greater stability to the stop element chain than in the seventh embodiment. This stability is improved further by the left and right side elements 203, 203 on either side of the intermediate element 243. The slider C can be slid much more smoothly by virtue of the greater rail stability.

Figure 43:
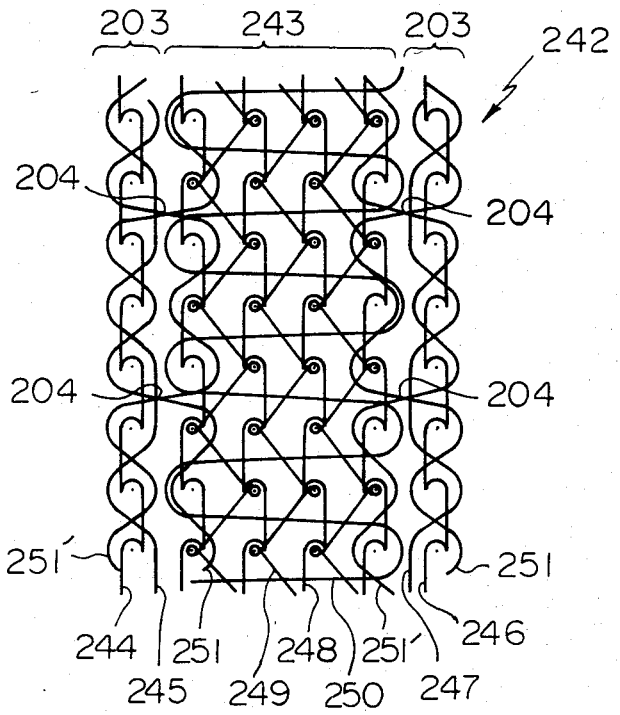
FIG. 43 is a point diagram showing the knit structure of the connecting member.
Figure 44:
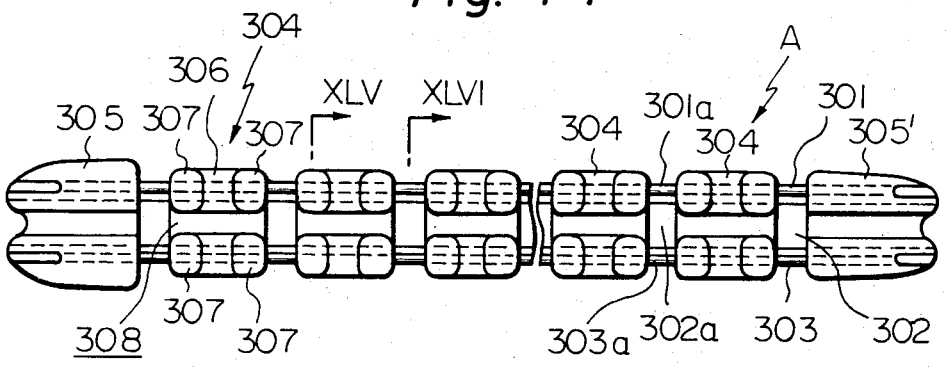
FIG. 44 is a plan view showing a rail of an 11th embodiment of the present invention.
Figure 45:
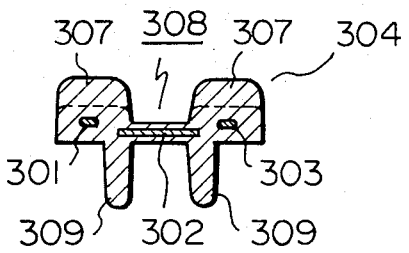
FIGS. 45 and 46 are sectional views taken along the lines XLV and XLVI of FIG. 44, respectively.
Figure 46:
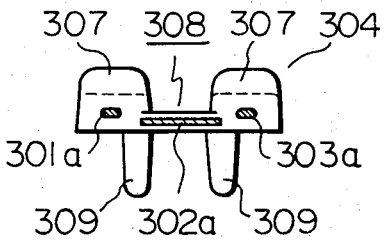

FIG. 43 is a point diagram for the structure of the connecting member 242 when it is formed by knitting. The left side element 203 of the connecting member comprises a knit structure formed by a chain stitch 244 of a 1-0/0-1 pattern and a warp-knitted yarn 245 laid in the 0-0/1-1/0-0 pattern. Likewise, the right side element 203 comprises a knit structure formed by a chain stitch 246 of the 1-0/0-1 pattern and a warp-knitted yarn 247 laid in the 1-1/0-0/1-1 pattern. The intermediate element 243 comprises four wales. A chain stitch 248 of the 1-0/0-1 pattern is arranged on each wale, a tricot stitch 249 of the 1-2/1-0 pattern is arranged between adjacent wales, and a woof yarn 250 of the 0-0/4-4 pattern is laid in as shown, thereby forming a longitudinally extending strip-like body. The side elements 203 and the intermediate element 243 are interconnected by laying in the interconnecting yarns 251, 251' in the patterns 0-0/1-1/0-0/2-2/1-1/2-2/ and 2-2/1-1/2-2/0-0/1-1/0-0/. Thus, each rung element 204 is composed of the interconnecting yarn portions 251, 251' extending between the side elements 203 and the intermediate element 243.

The rail according to the seventh through tenth embodiments as described above has its stop elements fixedly secured to the flexible ladder-shaped connecting member which comprises the side elements and rung elements, with the side and rung elements being embedded in the stop elements, and the stop elements are interconnected by the exposed portions of the side elements. The rail A therefore can be attached to the garment with an exact fit by exploiting the flexibility of the ladder-shaped connecting member. Moreover, the stop elements are secured to the connecting member very strongly at a predetermined pitch at the portions where the side and rung elements are embedded therein. The stop elements therefore can fully withstand intense pulling forces exerted by the locking projections of the slider. It is therefore possible to use the rail A on garment portions that are subjected to strong pulling force, such as at the waist of a skirt or pair of trousers.

A description of an 11th embodiment of the invention will now be had with reference to FIGS. 44 through 48. The rail A of this embodiment includes three elongate flexible connecting member 301, 302, 303 extending in parallel, as well as a plurality of spaced-apart stop elements 304, a slider stopper 305 and a slider insertion guide 305' affixed to and astride the connecting members by extrusion or injection molding. The rail A is attached to a garment using those portions of **302*a* of the connecting member 302 that interconnect adjacent stop elements 304 as the parts that are stitched to the garment, the stop elements being interconnected by the connecting member 302** at their central portion when measured across their width.

Each stop element 304 has a square base portion 306, two slider engaging portions 307, 307, spaced apart by a predetermined distance longitudinally of the rail, provided at the edges of both the left and right side of the base portion 306 on the obverse surface thereof, a stitching groove 308 formed in the obverse surface of the stop element 304 at the central portion thereof when measuring the stop element across its width, and slider guiding projections 309, 309 provided on the right and left sides of the base portion 306 on the reverse surface thereof. The stop elements 304 are fixedly secured to the connecting members 301, 302, 303 in a unitary manner owing to the adhesive force resulting from the extrusion or injection molding operation, with the connecting members 301, 302, 303 passing through the base portion 306 at its central portion and right and left side portions. The abovementioned predetermined distance between the slider engaging projections 307, 307 is maintained also between the projections 307, 307 on mutually adjacent stop elements 304.

The connecting member 302 is a flexible strip-like member such as a woven or knitted band, or a band made of synthetic resin. In the drawings the connecting member 302 is a woven or knitted band. Cords may be used as the connecting members 301, 303, or any flexible cord-like or narrow strip-like body may be employed.

To attach the rail A to the garment B, the slider guiding projections 309 of the stop elements 304 are abutted against the garment surface, and a yarn is passed over the portions **302*a* of the connecting member 302, engaged with the stitching grooves 308**, and then stitched into the surface of the garment.

In the above arrangement, the stop elements 304 are fixedly secured to the connecting members 301, 302, 303 at a predetermined pitch firmly and in a unitary manner owing to the adhesive force resulting from the extrusion or injection molding operation, with flexibility being maintained at the portions **301*a*, 302*a*, 303*a* of the connecting members 301, 302, 303 that are located between adjacent stop elements 304, 304, and with the stop element chain being held together firmly by the connecting members 301, 302, 303. This assures an attractive appearance since the rail A can be fitted exactly to the surface of the garment B and stitched in place without stiffening or wrinkling. Moreover, the stop elements 304 will not become dislodged from the connecting members 301, 302, 303 and can withstand prolonged use. In addition, the efficiency of the manufacturing operation is improved greatly since the stop elements 304 are affixed to the connecting members 301, 302, 303** by extrusion or injection molding.

Since the rail A is stitched into the garment at the portions **302*a* of the longitudinally extending the connecting member 302 centrally of the rail, the slider guiding projections 309, 309 on each stop element 304 are abutted against the garment surface to furnish the stop element chain with stability. This stability is improved further at the portions 301***a*, 303*a* of the connecting members 301, 303 on either side of the connecting member 302. The slider C can be slid much more smoothly by virtue of the greater rail stability.

Figure 47:
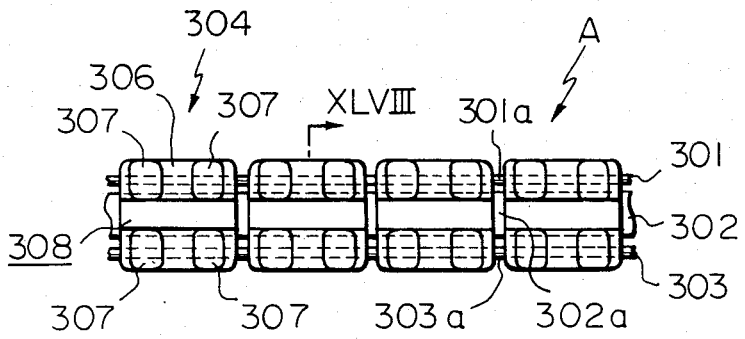
FIG. 47 is a plan view showing a rail portion which is a modification of the 11th embodiment.
Figure 48:
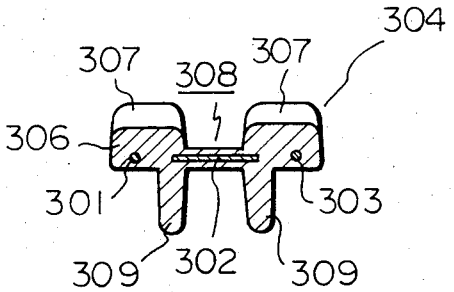
FIG. 48 is a sectional view taken along the line XLVIII of FIG. 47.
Figure 49:
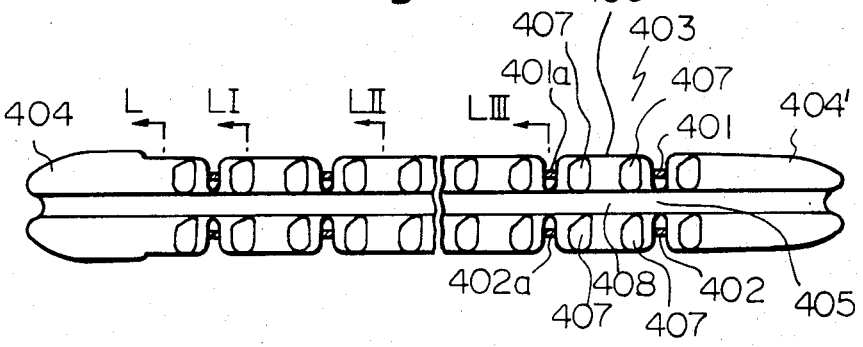
FIG. 49 is a plan view showing rail portion of a 12th embodiment of the present invention.
Figure 50:
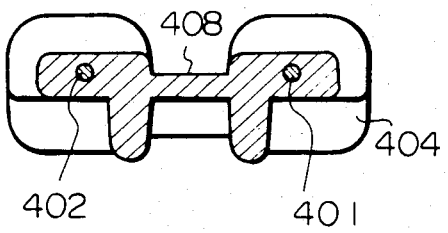
FIGS. 50 through 53 are sectional views taken along the lines L, LI, LII, and LIII of FIG. 49, respectively.
Figure 51:
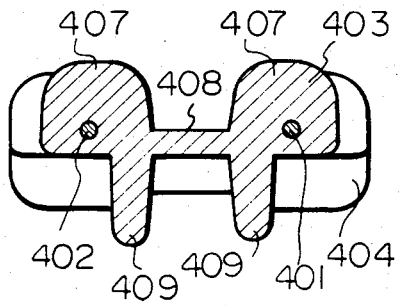
Figure 52:
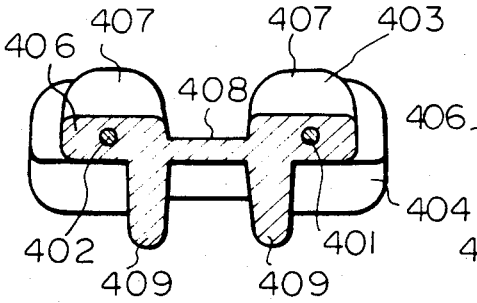
Figure 53:
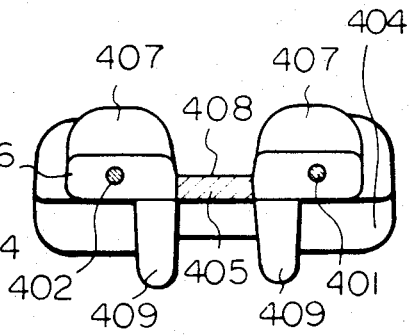

The modification shown in FIGS. 47, 48 provides even greater stability to the rail A by narrowing the spacing between the adjacent stop elements 304, 304 as much as possible but not to such an extent as will diminish the flexibility of the rail.

In the 11th embodiment described above, the adopted rail structure includes the three elongate flexible members extending in parallel, and the spaced-apart stop elements affixed to and astride these connecting members by extrusion or injection molding, with those portions of the connecting member that interconnect adjacent stop elements at the central portions thereof serving as the parts that are stitched to the garment. It is therefore possible to affix the stop elements efficiently while maintaining their spacing and the strength with which they are attached. This allows the highly productive manufacture of rails which have a uniform quality and which can withstand prolonged use. Moreover, the stop element chain is stabilized by stitching at the portions of the connecting member situated at the central portion of the rail when measured across its width, and this stability is enhanced by the portions of the connecting members situated on either side of the rail longitudinally thereof. An attractive appearance is assured since the rail can be attached firmly to the garment and fitted exactly to its surface by exploiting the flexibility of the connecting members.

A 12th embodiment of the invention is depicted in FIGS. 49 through 53. The rail A includes two elongate flexible connecting members 401, 402 extending in parallel, as well as a plurality of stop elements 403, a slider stopper 404 and a slider insertion guide 404' affixed to and astride the connecting members 401, 402 at a predetermined pitch by extrusion or injection molding. The rail A further includes a connecting strip 405, made of a synthetic resin, formed by extrusion or injection molding for interconnecting into a unitary structure the stop elements 403, the slider stopper 404, and the slider insertion guide 404'. The rail A is attached to a garment by stitching at the connecting strip 405.

Each stop element 403 has a square base portion 406, two slider engaging portions 407, 407, spaced apart by a predetermined distance longitudinally of the rail, provided at the edges of both the left and right side of the base portion 406 on the obverse side thereof, a stitching groove 408 formed in the obverse side of the stop element 403 at the central portion thereof when measuring the stop element across its width, and slider guiding projections 409, 409 provided on the right and left sides of the base portion 406 on the reverse surface thereof. The stop elements 403 are fixedly secured to the connecting members 401, 402 in a unitary manner owing to the adhesive force resulting from the extrusion or injection molding operation, with the connecting members 401, 402 passing through the base portion 406 at its right and left side portions. The abovementioned predetermined distance between the slider engaging projections 407, 407 is maintained also between the projections 407, 407 on mutually adjacent stop elements 403. Cords, or any flexible cord-like or narrow strip-like body, may be used as the connecting members 401, 402.

To attach the rail A to the garment B, the slider guiding projections 409 of the stop elements 403 are abutted against the garment surface, and a yarn is passed over the connecting strip 405, engaged with the stitching grooves 408, and then stitched into the surface of the garment.

In accordance with the 12th embodiment as described above, the stop elements 403 are fixedly secured to the connecting members 401, 402 at a predetermined pitch by the adhesive force resulting from the extrusion or injection molding operation and, at the same time, to the connecting strip 405, in a firm and unitary manner with the stop elements 403 being interconnected by the connecting strip 405. In addition, the connecting members 401, 402 reinforce the integrated and interconnected stop elements 403 and suppress excessive twisting of the stop elements in the longitudinal direction of the rail. While exhibiting these advantages, the rail retains flexibility at the connecting portions 401*a*, 402*a* between stop elements 403, and at the connecting strip 405. This assures an attractive appearance since the rail A can be fitted exactly to the surface of the garment B and stitched in place without stiffness and wrinkling. Moreover, the rail can withstand long use without the rows of stop elements becoming uneven. Suitable rigidity of a degree necessary for smooth sliding movement of the slider C is assured longitudinally of the rail. Since the rail A is stitched into the garment at the connecting strip 405 extending longitudinally along the center of the rail, the slider guiding projections 409, 409 on each stop element 403 are abutted against the garment surface to furnish the stop element rows with stability. This stability is improved further at the portions 401*a*, 402*a* of the connecting members 401, 402 on either side of the connecting strip 405. The slider C can be slid much more smoothly and reliably by virtue of the greater rail stability. Furthermore, the productivity of the manufacturing operation is improved greatly since the stop elements are affixed to the connecting members 401, 402 by extrusion or injection molding. Rail stability can be enhanced by narrowing the spacing between adjacent stop elements 403, 403 as much as possible but not to such an extent as will diminish the flexibility of the rail.

The rail structure according to the 12th embodiment of the invention as set forth above includes the two elongate flexible connecting members extending in parallel, the spaced-apart stop elements which are affixed to and astride these connecting members by extrusion or injection molding, and the synthetic resin connecting strip for interconnecting adjacent stop elements into a unitary body at the central portions of the stop elements when they are measured across their width. It is therefore possible to manufacture the rail very efficiently while maintaining the spacing of the stop elements and the strength with which they are attached. The rail can be stitched to the garment surface with an excellent fit by exploiting the flexibility of the connecting members, and the attachment is firm owing to the stabilized stop elements. At the same time, a suitable rigidity can be retained longitudinally of the rail so that the slider can be slid along the rail very easily.

As many apparently widely different embodiments of the present invention can be made without departing from the spirit and scope thereof, it is to be understood that the invention is not limited to the specific embodiments thereof except as defined in the appended claims.

What is claimed is:

1. An adjustable fastener comprising:

a rail for fitting on a garment so as to be overlying the surface of said garment, said rail having a plurality of individual spaced-apart stop elements and at least one elongate flexible connecting member extending along the length of said rail so that said rail is flexible between said stop elements; and, a slider fitting on said rail for adjustable sliding movement along the length thereof, said slider having a releasable locking member movable transversely of said rail;

said adjustable fastener being characterized in that said stop elements have respective base portions fixedly molded onto the connecting member and each of said stop elements being provided with, on the upper side of said respective base portion, two pairs of spaced-apart slider engaging projections protruding upwardly on opposed transverse sides of the base portion for selective engagement with said locking member of said slider therebetween, a central transverse channel formed between each said two pairs of projections for separately stitching each said base portion onto the surface of the garment, and one pair of slider guide means projecting downwardly on opposed transverse sides of each said respective base portion.

2. The adjustable fastener according to claim 1, in which said connecting member comprises two flexible cords extending in parallel adjacent opposed transverse sides of said base portions.

3. The adjustable fastener according to claim 2, in which each of said two flexible cords includes an expanded portion between adjacent ones of said stop elements.

4. The adjustable fastener according to claim 1, in which said connecting member is a single band which is knitted, woven or made of a synthetic resin, each of said plurality of stop elements being so as to envelop said band.

5. The adjustable fastener according to claim 1, in which said band has a stitching window, formed between adjacent ones of said stop elements, for stitching said band onto the surface of a garment.

6. The adjustable fastener according to claim 1, in which said connecting member is a single strip-like body having flexibility at the laterally extending central portion thereof, said central portion which has flexibility serving as the central channel for stitching said rail onto the surface of the garment.

7. The adjustable fastener according to claim 1, in which said rail includes:

a flexible ladder-shaped connecting member comprising a pair of side elements extending in parallel, and a plurality of rung members bridging said side elements, and a plurality of spaced-apart stop elements affixed to said ladder-shaped connecting member, with said ladder-shaped connecting member being embedded therein.

8. The adjustable fastener according to claim 1, in which said rail includes:

a flexible ladder-shaped connecting member comprising a pair of side elements extending in parallel, an intermediate element positioned intermediate said pair of side elements, and a plurality of rung elements bridging said intermediate element and said pair of side elements, and a plurality of spaced-apart stop elements affixed to said ladder-shaped connecting member, with said ladder-shaped connecting member being embedded therein.

9. The adjustable fastener according to claim 1, in which said rail comprises three flexible connecting members extending in parallel, and a plurality of spaced-apart stop elements molded astride said three connecting members, the centrally positioned one of said three connecting members serving as a part for stitching said rail onto the surface of a garment.

10. The adjustable fastener according to claim 1, in which said rail comprises:

two connecting members extending in parallel, a plurality of spaced-apart stop elements molded astride said two connecting members; and a synthetic resin connecting body for connecting said plurality of stop elements together at the laterally extending central portions thereof.

* * * * *